US007931222B2

(12) United States Patent
Stehr et al.

(10) Patent No.: US 7,931,222 B2
(45) Date of Patent: Apr. 26, 2011

(54) AGITATOR MILL

(75) Inventors: Norbert Stehr, Grünstadt (DE); Philipp Schmitt, Lampertheim (DE)

(73) Assignee: Bühler AG, Uzwil (CH)

( * ) Notice: Subject to any disclaimer, the term of this patent is extended or adjusted under 35 U.S.C. 154(b) by 0 days.

(21) Appl. No.: 12/840,242

(22) Filed: Jul. 20, 2010

(65) Prior Publication Data

US 2010/0282884 A1 Nov. 11, 2010

Related U.S. Application Data

(63) Continuation of application No. 12/089,849, filed as application No. PCT/EP2005/010910 on Oct. 11, 2005.

(51) Int. Cl.
*B02C 23/02* (2006.01)

(52) U.S. Cl. ..... 241/171; 241/172

(58) Field of Classification Search ..... 241/171, 241/172

See application file for complete search history.

(56) References Cited

U.S. PATENT DOCUMENTS

| | | | | |
|---|---|---|---|---|
| 2,764,359 | A * | 9/1956 | Szegvari | 241/15 |
| 3,332,628 | A * | 7/1967 | Wadham | 241/30 |
| 4,394,981 | A * | 7/1983 | Schold | 241/46.17 |
| 5,011,089 | A | 4/1991 | Vock et al. | |
| 5,062,577 | A | 11/1991 | Schmitt et al. | |
| 5,346,124 | A | 9/1994 | Chess | |
| 5,853,132 | A * | 12/1998 | Tsuji | 241/172 |
| 5,894,998 | A | 4/1999 | Schall et al. | |
| 5,996,914 | A * | 12/1999 | Stehr | 241/171 |
| 6,021,969 | A * | 2/2000 | Schmitt et al. | 241/171 |
| 6,460,791 | B1 * | 10/2002 | Stehr | 241/171 |

FOREIGN PATENT DOCUMENTS

| | | | |
|---|---|---|---|
| DE | 19638354 | A1 | 4/1998 |
| EP | 0448100 | A1 | 9/1991 |
| EP | 0504836 | B1 | 9/1992 |
| EP | 0546320 | A2 | 6/1993 |

* cited by examiner

*Primary Examiner* — Bena Miller

(74) *Attorney, Agent, or Firm* — Browdy and Neimark, PLLC

(57) ABSTRACT

An agitator mill for treating free-flowing grinding stock has a grinding receptacle and an interior stator disposed therein. A rotatably drivable annular cylindrical rotor is disposed between the interior stator and the receptacle wall, with a grinding chamber being defined between said rotor and the receptacle wall. A grinding-stock discharge conduit is formed between the rotor and the interior stator (22) which is connected to the grinding chamber by means of a deflection conduit. Devices are provided for preventing the carry-over of auxiliary grinding bodies from the grinding chamber into the grinding-stock discharge conduit.

18 Claims, 9 Drawing Sheets

AGITATOR MILL

This is a continuation of U.S. patent application Ser. No. 12/089,849, filed Dec. 9, 2008, which is the U.S. National Phase application of International. Application No. PCT/EP05/010910 filed Oct. 11, 2005, the contents of each of which are incorporated herein.

BACKGROUND OF THE INVENTION

1. Field of the Invention

The invention relates to an agitator mill comprising a grinding receptacle which defines a substantially closed grinding chamber by means of a receptacle wall and, comprising an agitator which is rotatably drivably disposed in the grinding receptacle in a direction of rotation and which is cup-shaped with respect to a common central longitudinal axis, and which has an annular cylindrical rotor which is provided with implements extending as far as into the vicinity of the receptacle wall, and comprising an interior stator which is disposed within the rotor, which is joined to the grinding receptacle, and which has a closed outer wall, wherein the annular cylindrical grinding chamber is formed between the receptacle wall and the rotor and receives auxiliary grinding bodies with a diameter c, and wherein an annular cylindrical interior chamber in the shape of an annular gap is formed between the rotor and the outer wall of the interior stator, said interior chamber being disposed coaxially within the grinding chamber and connected thereto via a deflection conduit, and wherein the grinding chamber is at least partially filled with auxiliary grinding bodies, and wherein a grinding-stock supply chamber, which is disposed upstream of the grinding chamber and opens into the latter in a direction of flow, and a protective screen, which is disposed downstream of the interior chamber in the direction of flow, are disposed approximately on the same side of the grinding receptacle for the grinding stock to pass through, and wherein auxiliary-grinding-body return conduits are provided in the agitator for returning the auxiliary grinding bodies from the vicinity of the protective screen into the grinding chamber, said return conduits connecting the end of the interior chamber to the beginning of the grinding chamber.

2. Background Art

Such an agitator mill is known from U.S. Pat. No. 5,062,577. In this agitator mill, the auxiliary grinding bodies are centrifuged from the flow of grinding stock and auxiliary grinding bodies via the auxiliary-grinding-body return conduits before said flow reaches the protective screen. The basic function of the protective screen is to collect worn-out auxiliary grinding bodies which are too light to be thrown out via the auxiliary-grinding-body return conduits, thus serving as a throttle device for generating a counter-pressure counteracting the flow of grinding stock. The agitator is provided with agitator implements protruding into the exterior grinding chamber. When using extremely small auxiliary grinding bodies, it is not ensured that the auxiliary grinding bodies will not eventually reach the protective screen, thus gradually clogging the latter. In particular when using extremely small auxiliary grinding bodies, it is required to use correspondingly fine protective screens which in turn may be damaged very easily, should they be hit by auxiliary grinding bodies. If, however, relatively viscous grinding stocks are to be treated by using auxiliary grinding bodies of a usual size, a partially clogged protective screen leads to a substantial pressure build-up in the agitator mill, which also results in a disturbance of the grinding process.

An agitator mill is known from EP 0 504 836 B1 which has a cup-shape rotor disposed in a cylindrical housing, said rotor being provided with passage slots along the length thereof. An interior stator comprising a protective screen is disposed within the rotor. The exterior grinding chamber is provided with implements that are fixed to both the rotor and the wall delimiting the grinding chamber. This agitator mill is not suitable for the use of extremely small auxiliary grinding bodies. Moreover, said mill is subject to the same problems as already described above.

An agitator mill is known from U.S. Pat. No. 5,011,089, said agitator mill having a rotor with paddle-shaped implements disposed on the outside thereof. A protective screen is disposed within the rotor. The rotor is composed of axially parallel bars to which the paddle-shaped implements are fastened. The grinding stock is supplied radially. Owing to the paddle-shaped design of the agitator implements, this agitator mill ensures a concentration of auxiliary grinding bodies to be obtained in the area of the receptacle wall; a defined grinding, in particular by means of extremely small auxiliary grinding bodies as well as a reliable separation of the auxiliary grinding bodies without the risk of operational failures is however not obtainable either. Since the grinding stock flows through the packing of auxiliary grinding bodies in a radial direction, the grinding stock is subject to a grinding process over a very short distance only. Accordingly, if the grinding stock passes through the agitator mill only once, only a moderate grinding progress is obtained.

An agitator mill of the generic type is known from U.S. Pat. No. 5,894,998, said agitator mill having a protective screen fixed to the cup-shaped rotor which is sealed against the interior stator by means of a mechanical seal. The protective screen thus co-rotates with the rotor, thereby ensuring that auxiliary grinding bodies reaching said filter are thrown out even more efficiently.

An agitator mill is known from U.S. Pat. No. 5,346,124, with implements having transport surfaces being fixed to the rotor thereof and imparting a momentum to the grinding stock and the auxiliary grinding bodies in the direction from the grinding-stock inlet to the grinding-stock discharge.

SUMMARY OF THE INVENTION

It is the object of the invention to develop an agitator mill of the generic type in a way as to obtain a grinding and dispersing effect with a narrow particle distribution even if the grinding stock passes through the agitator mill only once, in particular when using auxiliary grinding bodies having an extremely small diameter, whilst avoiding the risk of operational failures, caused in particular by auxiliary grinding bodies hitting the protective screen.

This object is attained according to the invention by an agitator mill in which the interior chamber is a grinding-stock discharge conduit, and in which devices are provided to prevent a carry-over of auxiliary grinding bodies from the grinding chamber into the grinding-stock discharge conduit. The crux of the invention is that auxiliary grinding bodies are only located in the grinding chamber between the rotor and the receptacle wall and are concentrated in said grinding chamber. Concentrating the auxiliary grinding bodies in said grinding chamber already ensures that said auxiliary grinding bodies do not enter the grinding-stock discharge conduit. Fastened to the rotor, the implements extend as far as into the vicinity of the receptacle wall, thereby ensuring that the auxiliary grinding bodies are accelerated outward and concentrated together. The grinding stock flows through the close-packed grinding stock in the axial direction so as to obtain a uniform grinding and dispersion. Along with the measures for concentrating auxiliary grinding bodies in the annular exterior grinding chamber, devices are provided for effectively preventing the auxiliary grinding bodies from reaching the protective screen. The grinding-stock discharge conduit, which is located within the rotor and is defined by the rotor and the interior stator, contains no or only very few auxiliary grinding bodies, thereby effectively eliminating the drawbacks described above.

The measures according to which the gap between the implements and the receptacle wall has a gap width b to which applies in relation to the diameter c of the auxiliary grinding bodies: $4c \leqq b \leqq 6c$, the minimum gap width b being defined as: $1.0\ mm \leqq b \leqq 2.0\ mm$, contribute to a concentration of the auxiliary grinding bodies in the grinding chamber.

The measures according to which the gap between the implements and the receptacle wall has a gap width b to which applies in relation to the diameter c of the auxiliary grinding bodies: $4 \leqq b \leqq 6c$, the minimum gap width b being defined as: $1.0\ mm \leqq b \leqq 2.0\ mm$, and according to which, seen in the circumferential direction of the rotor, the implements are disposed along a second helical curve in a second area between the auxiliary-grinding-body return conduits and the deflection conduit so as to overlap with one another, thereby imparting a momentum to the auxiliary grinding bodies that is opposite to the direction of flow when the rotor is rotatably driven in a direction of rotation, and according to which the grinding chamber has a bottom surface upstream of the deflection conduit, said bottom surface being wiped by the nearest implement while leaving a distance g uncovered, further help to prevent the auxiliary grinding bodies from entering the deflection conduit.

The development according to which the following applies to the distance g between the bottom surface and the nearest implement (in relation to the diameter c of the auxiliary grinding bodies: $4c \leqq g \leqq 6c$, with the minimum distance g being defined as: $1.0\ mm \leqq g \leqq 2.0\ mm$, prevents the few auxiliary grinding bodies that do reach the grinding-stock discharge conduit from depositing, thereby causing them to remain in the flow towards the auxiliary-grinding-body return conduits where they are re-supplied into the beginning of the grinding chamber. The measures according to which the deflection conduit projects out of the grinding chamber directly next to the rotor and according to which the bottom surface is disposed radially beyond thereof, ensure that the auxiliary grinding bodies are furthermore accelerated in the direction of the auxiliary-grinding-body return conduits.

The development according to which wiper elements extending towards the rotor are disposed along the interior stator, and according to which the rotor is free of implements on the inside thereof defining the grinding-stock discharge conduit, prevents a layer of grinding stock and auxiliary grinding bodies from forming at the inside of the rotor that no longer takes part in the process.

The development according to which the wiper elements disposed along the interior stator overlap with one another in the direction of the central longitudinal axis and are disposed along a helical curve in the circumferential direction of the interior stator in a way as to impart a momentum to the auxiliary grinding bodies in the direction of flow when the rotor is driven in the direction of rotation, is particularly advantageous in conjunction with the measures mentioned above owing to the particularly intensive cooling of in particular temperature-sensitive grinding stock in the grinding-stock discharge conduit without requiring any additional supply of energy, said grinding stock thus being subject to high energy only during the actual grinding process in the grinding chamber.

The embodiment according to which the wiper elements leave a gap in relation to the rotor to the gap width e thereof applies the following in relation to the diameter c of the auxiliary grinding bodies: $4c \leqq e \leqq 6c$, with a minimum gap width e being defined as: $1.0\ mm \leqq c \leqq 2.0\ mm$, enables auxiliary grinding bodies present in the grinding-stock discharge conduit to be directly thrown outward into the grinding chamber, this effect being promoted by the development of an agitator mill in which the protective screen is joined to the agitator in a non-rotational manner, and in which a discharge of the protective screen directly projects into a grinding-stock discharge conduit which is stationary with respect to the grinding receptacle.

Appropriate diameter ranges for extremely small auxiliary grinding bodies being return conduits connecting the grinding-stock discharge conduit to the grinding chamber are formed in the rotor to the diameter h thereof applies: $5.0\ mm \leqq h \leqq 30.0\ mm$.

Further features, advantages and details will become apparent from the ensuing description of embodiments of the invention, taken in conjunction with the drawing.

DESCRIPTION OF THE PREFERRED EMBODIMENTS

Figure 1:
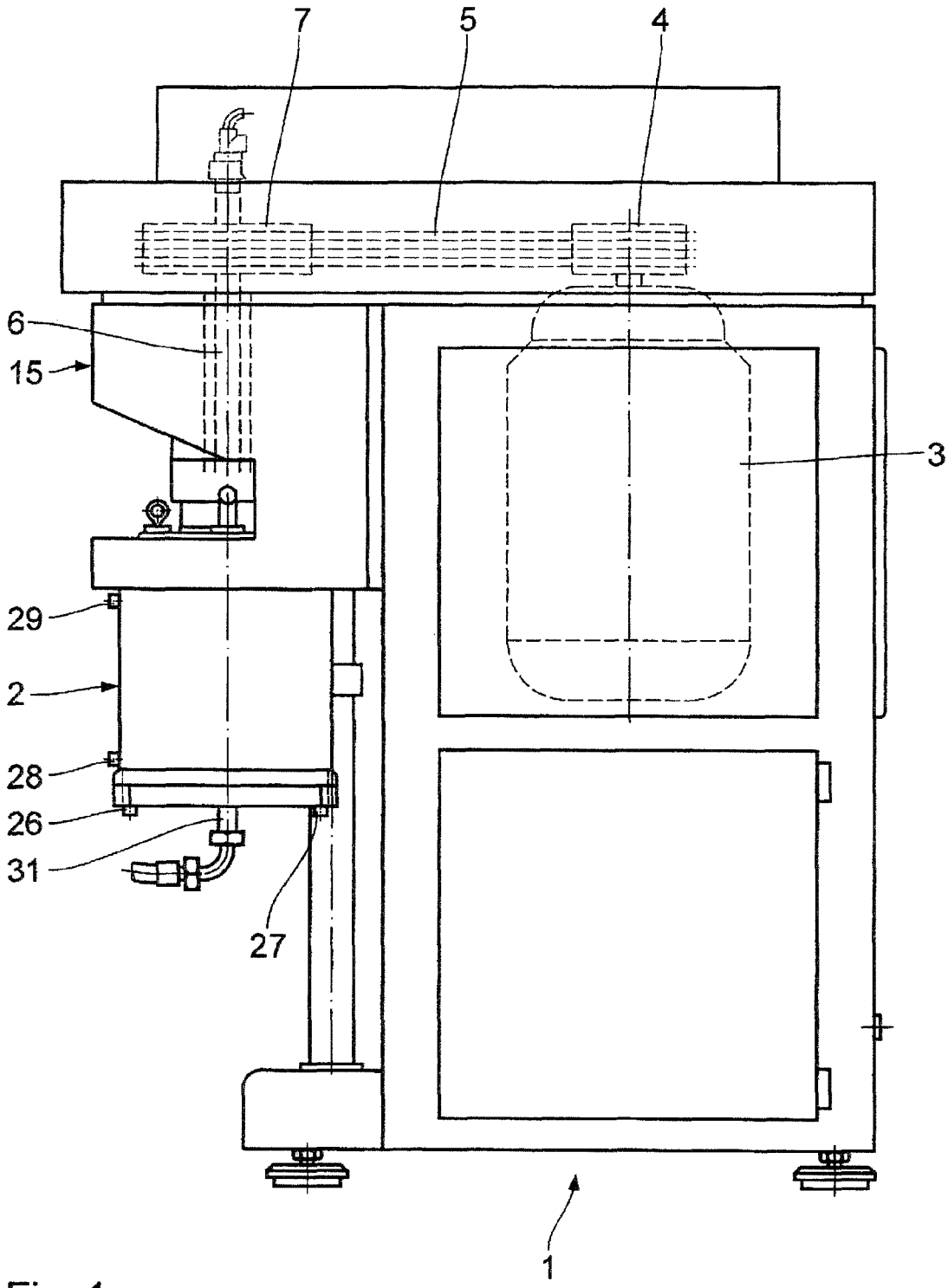
FIG. 1 shows a schematic lateral view of an agitator mill.

The agitator mill shown in FIG. 1 has a stand 1 in the usual manner to which a cylindrical grinding receptacle 2 may be fixed. This stand 1 houses an electric drive motor 3 which is provided with a V-belt pulley 4 for rotatably driving a V-belt pulley 7, which is connected to a drive shaft 6 in a non-rotational manner, by means of V-belts 5.

Figure 2:
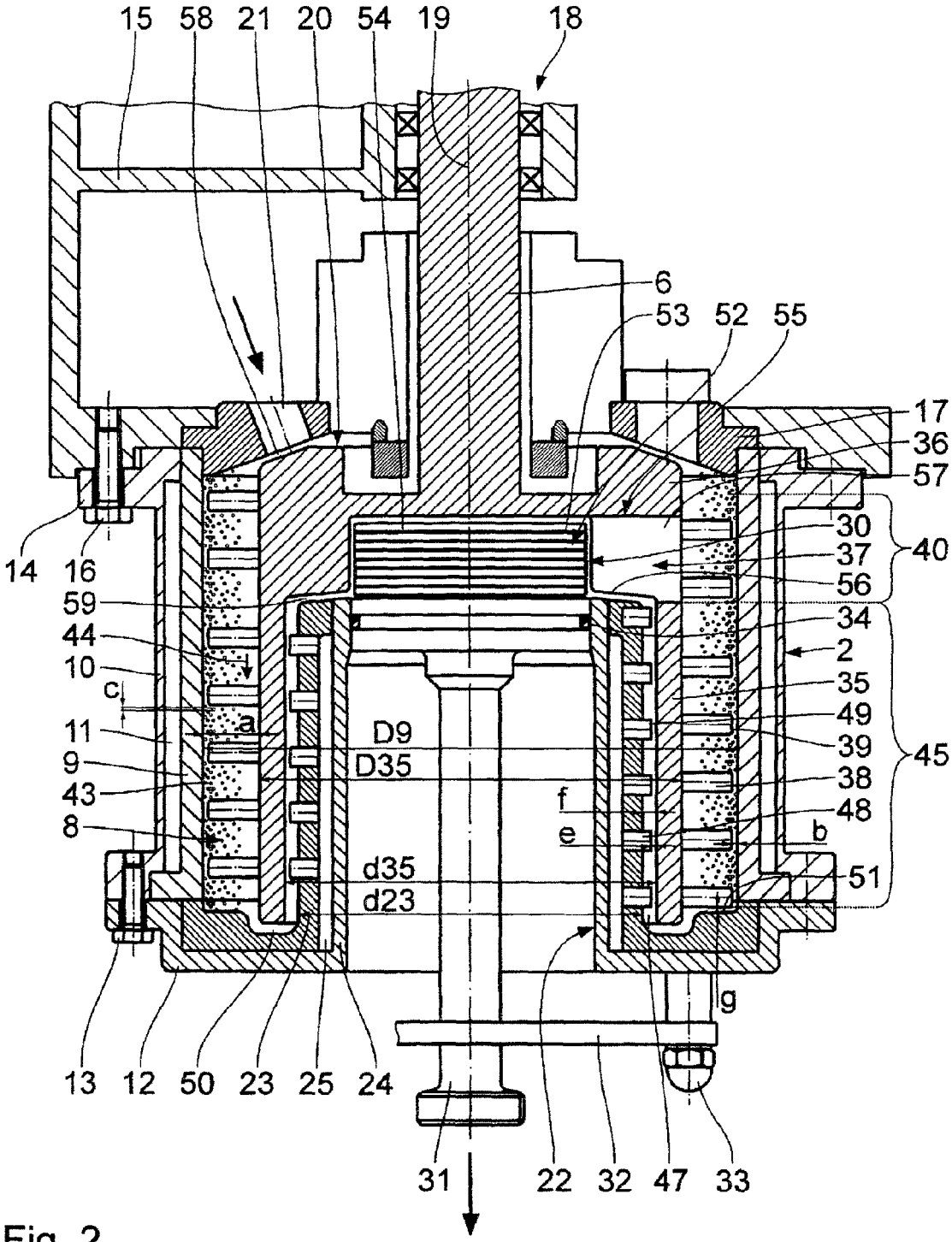
FIG. 2 shows a vertical longitudinal section through a first embodiment of an agitator mill.
Figure 3:
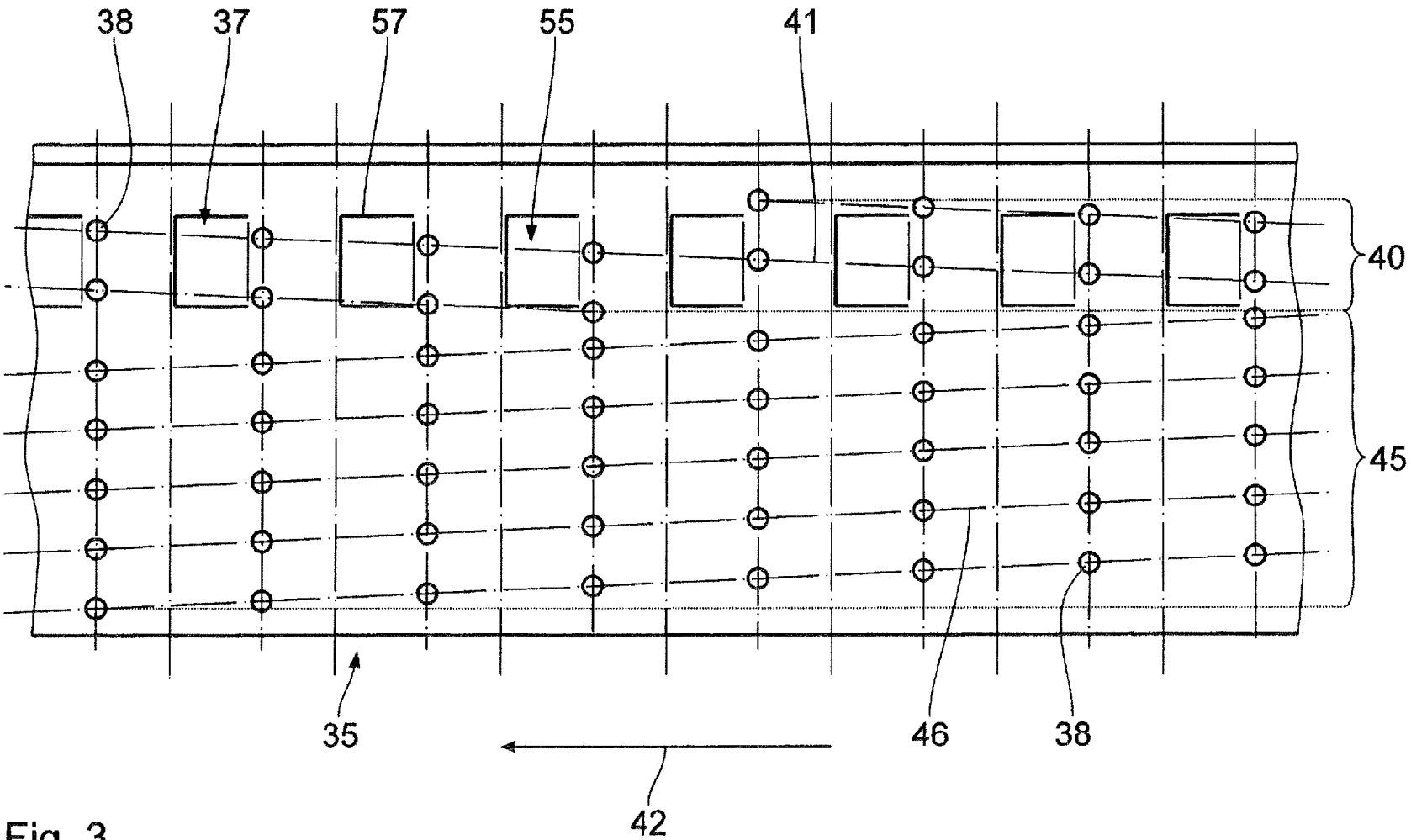
FIG. 3 shows a true length of the outside of the rotor of the agitator mill according to FIG. 2.

As can be seen in particular from FIGS. 2 and 3, the grinding receptacle 2 has a cylindrical receptacle wall 9 surrounding a grinding chamber 8, said receptacle wall 9 being surrounded by a substantially cylindrical cooling casing 10. The receptacle wall 9 and the cooling casing 10 define a cooling chamber 11 between each other. The lower closing element of the grinding chamber 8 is formed by a circular bottom plate 12 which is fastened to the grinding receptacle 2 by means of screws 13.

The grinding receptacle 2 has an upper annular flange 14 by means of which it is fastened to the underside of a support housing 15 by means of screws 16, said support housing 15 being fixed to the stand 1 of the agitator mill. The grinding chamber 8 is closed by a lid 17. The support housing 15 has a central bearing and sealing housing 18 which is aligned coaxially with the central longitudinal axis 19 of the grinding receptacle 2. This bearing and sealing housing 18 is penetrated by the drive shaft 6 which also extends coaxially with the axis 19 and is provided with an agitator 20.

A grinding-stock supply line 21 projects into the area of the bearing and sealing housing 18 neighbouring the grinding chamber 8.

An approximately cup-shaped, cylindrical interior stator 22 projecting into the grinding chamber 2 is disposed on the bottom plate 12, said interior stator 22 having an outer wall 23 aligned coaxially with the axis 19 and a cylindrical inner casing 24 within said outer wall 23. Between each other, the outer wall 23 and the inner casing 24 define a cooling chamber 25 of the interior stator 22. The cooling chamber 25 is supplied with cooling water via a cooling-water supply connector 26, said cooling water being discharged via a cooling-water discharge connector 27. The cooling chamber 11 of the grinding receptacle 2 is supplied with cooling water via a cooling-water supply connector 28, said cooling water being discharged via a cooling-water discharge connector 29.

As shown in the drawing, a protective screen 30 is disposed at the upper end of the interior stator 22, said protective screen 30 being connected to a grinding-stock discharge line 31. In the area of the bottom plate 12, the discharge line 31 is provided with a handle 32 which is detachably connected to the bottom plate 12 by means of screws 33.

The protective screen 30 is sealed against the interior stator 22 by means of a seal 34 and may be, together with the discharge line 31, pulled downwards out of the interior stator 22 after loosening the screws 33.

The agitator 20 has a cup-shaped basic structure, thus having a substantially annular cylindrical rotor 35. The agitator 20 has a lid-type closing member 36 of the rotor 35 at the upper end thereof. An auxiliary-grinding-body return device 37 is disposed in the agitator 20, strictly speaking in the transition area between the lid-type closing member 36 and the annular cylindrical, i.e. tubular, rotor 35.

The following applies to the radial width a of the grinding chamber 8: $a=(D9-D35)/2$, with D9 being the diameter of the receptacle wall 9, i.e. the external diameter of the grinding chamber 8, and with D35 referring to the external diameter of the rotor 35, i.e. the internal diameter of the grinding chamber. The following applies: $0.6 \leqq D35/D9 \leqq 0.95$, and preferably, $0.7 D35/D9 \leqq 0.85$.

The inside of the receptacle wall 9 is cylindrically smooth, having no implements projecting into the annular grinding chamber 8. On the other hand, the outside of the equally cylindrical rotor 35 is provided with peg-style implements 38 radially projecting into the grinding chamber 8 with respect to the central longitudinal axis 19. Said implements 38 almost extend as far as the receptacle wall 9, thus only leaving a gap 39 determined by construction and having a gap width b. As can be seen from FIG. 3, the implements 38 are helically disposed along the rotor surface. The implements 38 are disposed in the first area 40 assigned to the closing member 36 and are disposed along a first helical curve 41 which is formed in a way as to enable the implements 38 to have a transport effect on the auxiliary grinding bodies 43, which are present in the grinding chamber 8 and have a diameter c, downwards in the direction of flow 44 of the grinding stock, i.e. towards the bottom plate 12, when the agitator mill 20, and therefore the rotor 35, rotates in the direction of rotation 42. This first area 40 comprising the implements 38 disposed along the first helical curve 41 approximately extends as far as the lower side of the return device 37, as can be seen from FIG. 3.

In a second area 45 below the first area 40, the implements 38 are disposed along a second helical curve 46 extending in the opposite direction, with the momentum thus imparted to the auxiliary grinding bodies 43 being directed opposite to the direction of flow 44 of the grinding stock when the agitator 20 is driven in the direction of rotation 42. As can be seen from FIG. 3, implements 38 disposed next to one another in the circumferential direction of the rotor 35 are disposed both along the first helical curve 41 and along the second helical curve 46 in a way as to overlap with one another in the direction of the central longitudinal axis 19, thus ensuring that the receptacle wall 9 is completely wiped by the implements 38 for every revolution of the rotor 35.

Figure 4:
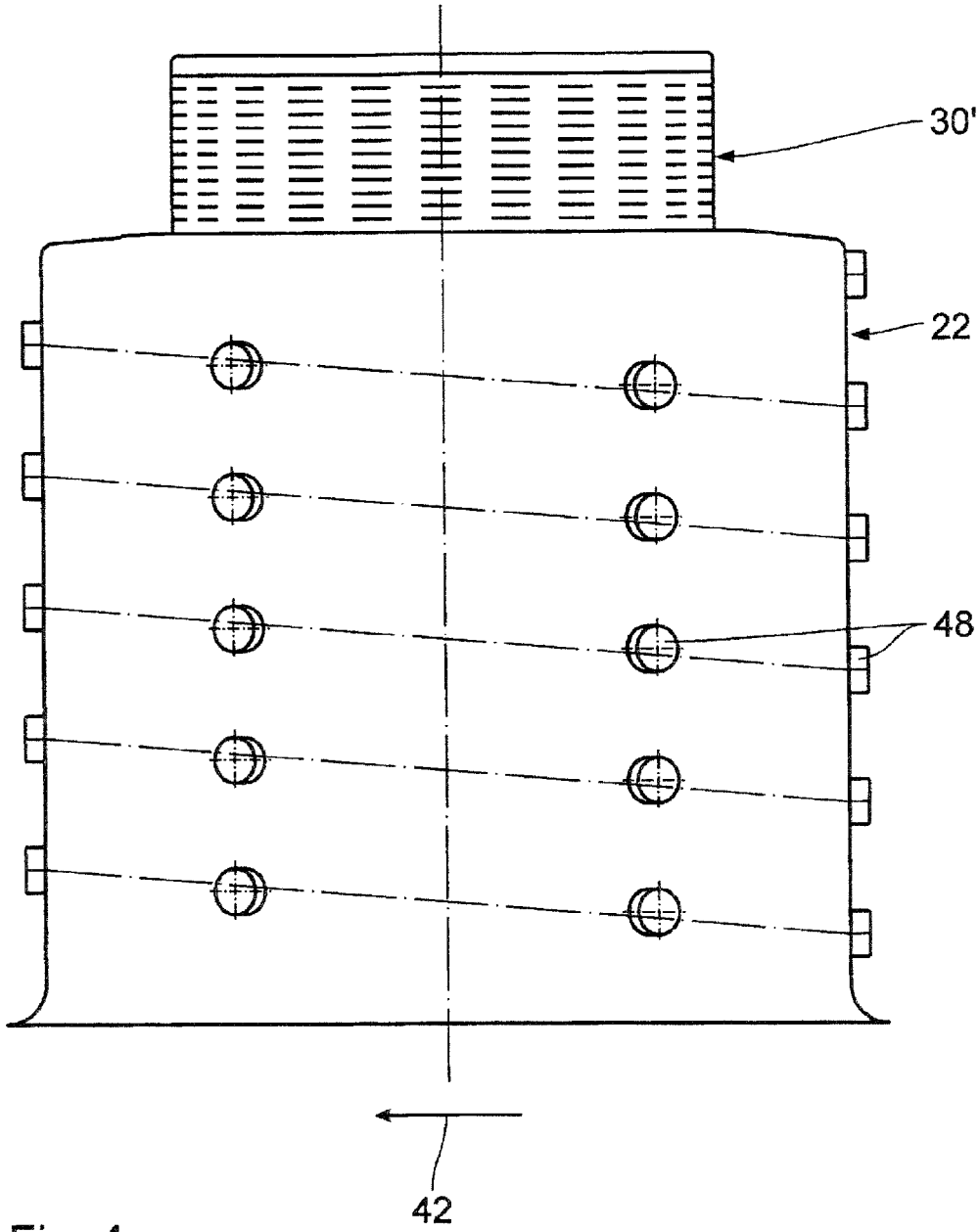
FIG. 4 shows a lateral view of the interior stator of the agitator mill according to FIGS. 2 and 3.

An annular cylindrical grinding-stock discharge conduit 47 is formed between the rotor 35 and the outer wall 23 of the interior stator 22. The outer wall 23 of the interior stator 22 is provided with peg-style wiper elements 48 radially projecting outwards into the discharge conduit 47. As can be seen from FIG. 4, wiper elements 48 disposed next to one another in the circumferential direction of the interior stator 22 are disposed in the direction of the central longitudinal axis 19 in a way as to overlap with one another, thus ensuring that for every revolution of the rotor 35, the wall thereof is completely wiped by said elements 48. Said elements 48 are disposed along a helical curve which extends in a way that when the rotor 35 is driven in the direction of rotation 42, this enables them to impart a momentum, in the direction of flow 44, to auxiliary grinding bodies 43 that may have entered the discharge conduit 47. The wiper elements 48 have a gap 49 in relation to the interior stator 22, the gap width e thereof not exceeding the minimum width required by construction.

The following applies to the gap width b of the gap 39 in relation to the diameter c of the auxiliary grinding bodies 43: $4c \leqq b \leqq 6c$, with a minimum marginal condition of $1.0\ \text{mm} \leqq b \leqq 2.0\ \text{mm}$ being defined for the use of particularly small auxiliary grinding bodies 43. Correspondingly, the following applies to the gap width e of the gap 49 in relation to the diameter c of the auxiliary grinding bodies 43: $4c \leqq e \leqq 6c$, with the minimum marginal condition of $1.0\ \text{mm} \leqq e \leqq 2.0\ \text{mm}$ equally applying to the use of extremely small auxiliary grinding bodies. This design enables the implements 38 to constantly swirl the packing of auxiliary grinding bodies in the grinding chamber 8. When driven, the rotor 35 is uniformly wiped by the wiper elements 48 owing to the small gap width e. When using auxiliary grinding bodies 43 of an extremely small diameter c, i.e. micro-auxiliary grinding bodies, the following applies to the diameter c thereof: $20\ \mu\text{m} \leqq c \leqq 100\ \mu\text{m}$.

The discharge conduit 47 has a radial width f to which applies: $f=(d35-d23)/2$, with d35 referring to the internal diameter of the rotor 35, i.e. the external diameter of the discharge conduit 47, and d23 referring to the external diameter of the interior stator 22, i.e. the internal diameter of the discharge conduit 47. The following applies: $0.8 \leqq d23/d35 \leqq 0.98$, and preferably $0.9 \leqq d23/d35 \leqq 0.98$. The grinding chamber 8 is connected to the discharge conduit 47 by means of a deflection conduit 50, the width thereof approximately equaling that of the discharge conduit 47, as can be seen from FIG. 2. Said deflection conduit 50 thus surrounds the free lower end of the rotor 35. Adjacent to the deflection conduit 50, the grinding chamber 8 is substantially closed by means of a bottom surface 51 extending radially toward the axis 19, with the lowest, i.e. next adjacent implement 38 rotating in close proximity to said bottom surface 51 at a distance g approximately equaling that of the gap widths b and e. Therefore, it is also in this area that auxiliary grinding bodies 43 are accelerated radially outward just before entering the deflection conduit 50 so as to be transported away from the deflection conduit 50.

As indicated in FIG. 2, the cylindrical protective screen 30 is composed of a stack of annular disks 52 which are spaced apart from one another so as to form a separation gap 53 between two disks 52 each, the width thereof being smaller than the diameter c of the smallest auxiliary grinding bodies 43 in use. The front side, i.e. the side facing towards the shaft 6, of the stack of annular disks 52 is closed by means of a closing plate 54. The protective screen 30 is disposed within the return device 37.

As can be seen from FIGS. 2 and 3, auxiliary-grinding-body return conduits 55 are formed in the return device 37. The respective inlet 56 thereof is directly adjacent to the return conduit 47 and to the protective screen 30. The respective outlet 57 thereof into the beginning area of the grinding chamber 8, strictly speaking into the first area 40 of the helically disposed implements 38. As can be seen from FIG. 3, the respective outlets 57 are disposed directly in front of one or several implements 38 when seen in the direction of rotation 42, thereby imparting a momentum to auxiliary grinding bodies 43 returning via a discharge conduit 47 in the direction of flow 44 as soon as they have been discharged through the outlet 57.

When flowing through the grinding chamber 8 in the direction of flow 44, the grinding stock flows downward from the grinding-stock supply line 21 through a grinding-stock supply chamber 58 disposed between the closing member 36 of the agitator 20 and the lid 17, the first area 40 and the second area 45 of the grinding chamber 8 before flowing radially inward via the deflection conduit 50 and from there, upward into a discharge conduit 59 via the grinding-stock discharge conduit 47, said discharge conduit 59 being formed between the closing member 36 and the interior stator 22 and substantially extending radially inward towards the protective screen 30. Afterwards, the grinding stock passes through the protective screen 30 to enter the grinding-stock discharge line 31 through which it is discharged from the agitator mill.

When passing through the grinding chamber 8, the grinding stock is ground due to the rotating agitator 20 in cooperation with the auxiliary grinding bodies 43. An amount of tangential momentum is imparted to the auxiliary driving bodies by the implements 38, thereby moving them in the direction of the receptacle wall 9. As indicated in the drawing, this causes the auxiliary grinding bodies 43 to be concentrated in the radially outer area of the grinding chamber 8. The small width b of the gap 39 between the implements 38 and the receptacle wall 9 prevents auxiliary grinding bodies 43 from depositing at the receptacle wall 9; even auxiliary grinding bodies 43 that have moved there are activated and entrained over and over again. The already described arrangement of implements 38 along the two helical curves 41 and 46 prevents the auxiliary grinding bodies 43 in the upper first area 40 from flowing back into the grinding-stock supply line 21 via the grinding-stock supply chamber 58. The arrangement of the agitator implements in the second area 45 prevents auxiliary grinding bodies 43, or at least most of them, from entering the discharge conduit 47 via the deflection conduit 50. This gives rise to a turbulent flow in the grinding chamber 8 characterized by strongly interacting vortices within the grinding stock when flowing through the grinding chamber 8, thereby preventing a linear movement thereof. This causes the individual grinding-stock particles to alternately flow from the rotor 35 to the receptacle wall 9 and vice versa. In the direction of flow 44, the throughput of the agitator mill is superimposed on this radially reciprocating flow, with the magnitude of the velocity component in the direction of flow 44 being obtained from the volumetric throughput of grinding stock per unit of time and the free cross-section of the grinding chamber 8, strictly speaking the cross-section of the grinding chamber 8 minus the cross-section of the available auxiliary grinding bodies 43.

If auxiliary grinding bodies 43 do manage to enter the grinding-stock discharge conduit 47 despite the described measures, they are transported through the entire discharge conduit 47 together with the grinding stock by means of the wiper elements 48 before being returned into the first area 40 of the grinding chamber 8 via the return device 37.

Figure 5:
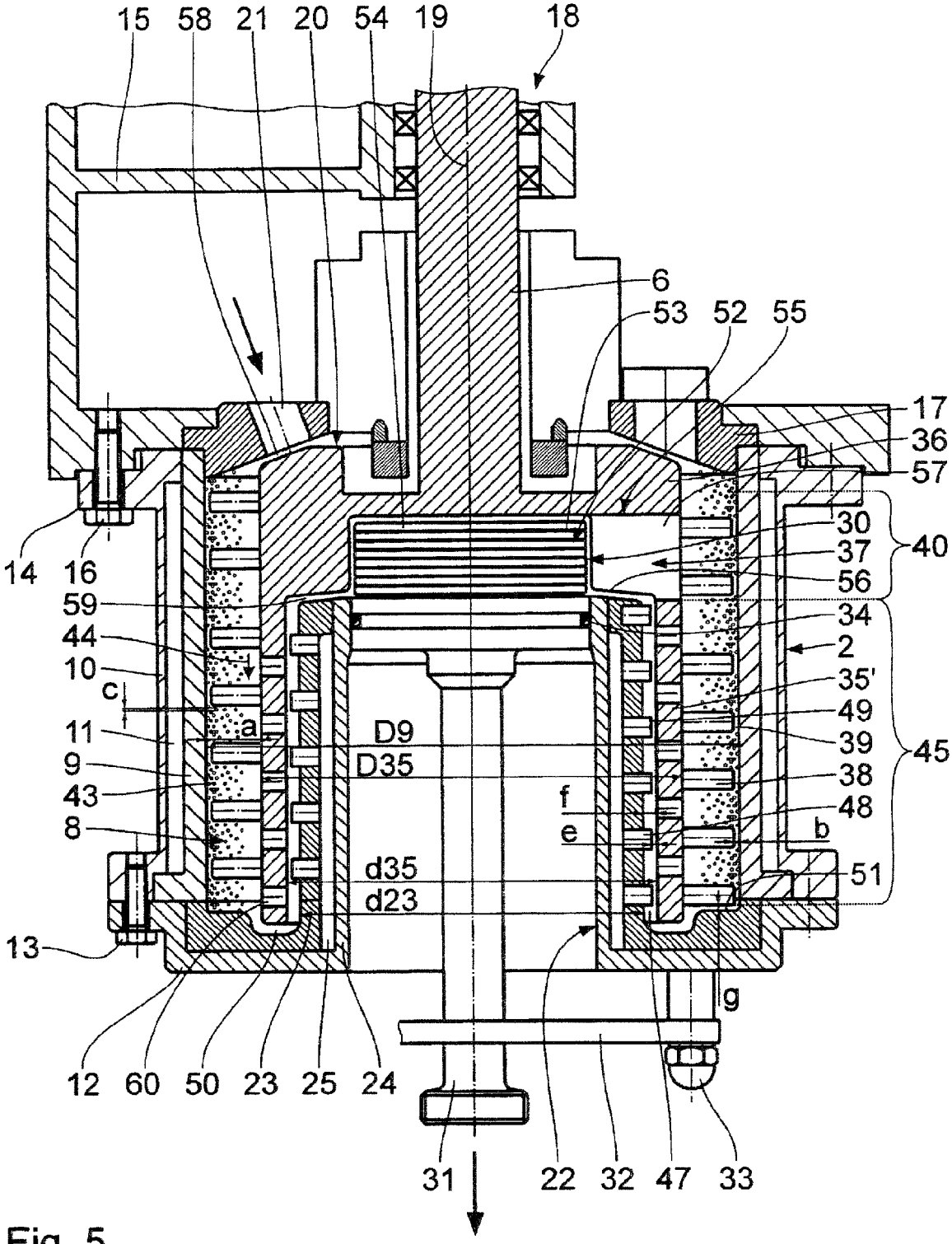
FIG. 5 shows a vertical longitudinal section through a second embodiment of the agitator mill.

The embodiment according to FIG. 5 differs from that according to FIG. 2 only in that additional, small auxiliary-grinding-body return conduits 60 in the shape of bores are formed along the axial length of the rotor 35' which are distributed along the circumference thereof and have a diameter h of 5.0 to 30.0 mm. From the annular cylindrical grinding-stock discharge conduit 47, said return conduits 60 thus directly project into the second area 45 of the grinding chamber 8, thereby ensuring that auxiliary grinding bodies 43 that have entered the grinding-stock discharge conduit 47 despite the described measures are already returned into the grinding chamber 8 before reaching the upper return device 37.

Figure 6:
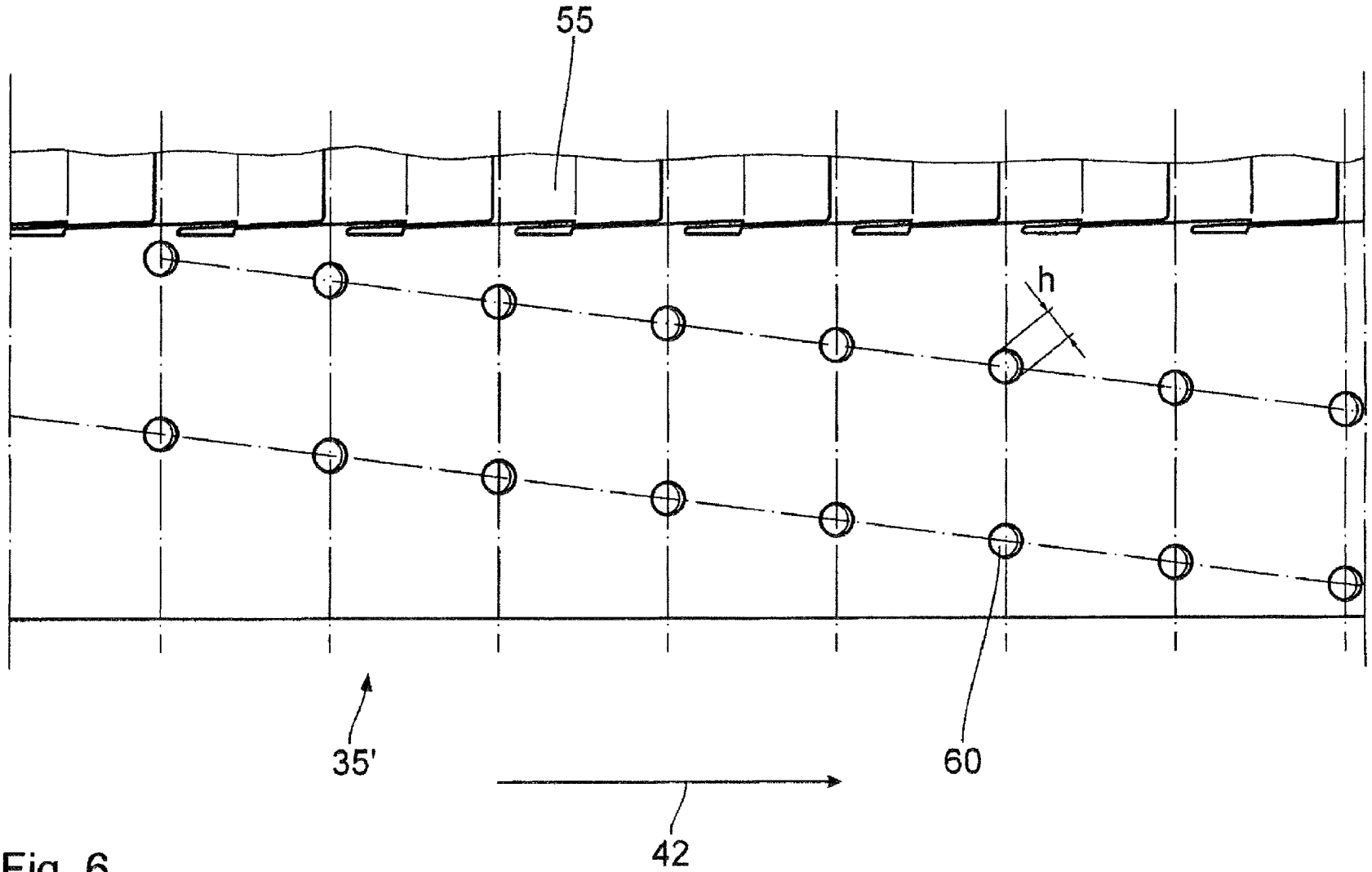
FIG. 6 shows a true length of the inside of the rotor of the agitator mill according to FIG. 5.

As can be seen from the true length of the inside of the rotor 35' shown in FIG. 6, the small auxiliary-grinding-body return conduits 60 are disposed along helical curves, said conduits 60 being disposed next to one another so as to overlap with one another in the circumferential direction, thereby ensuring that auxiliary grinding bodies 43 that have managed to enter the grinding-stock discharge conduit 47 and have been centrifuged off the rotor 35 are forced to flow by at least one such conduit 60 through which they may be returned into the exterior grinding chamber 9.

Figure 7:
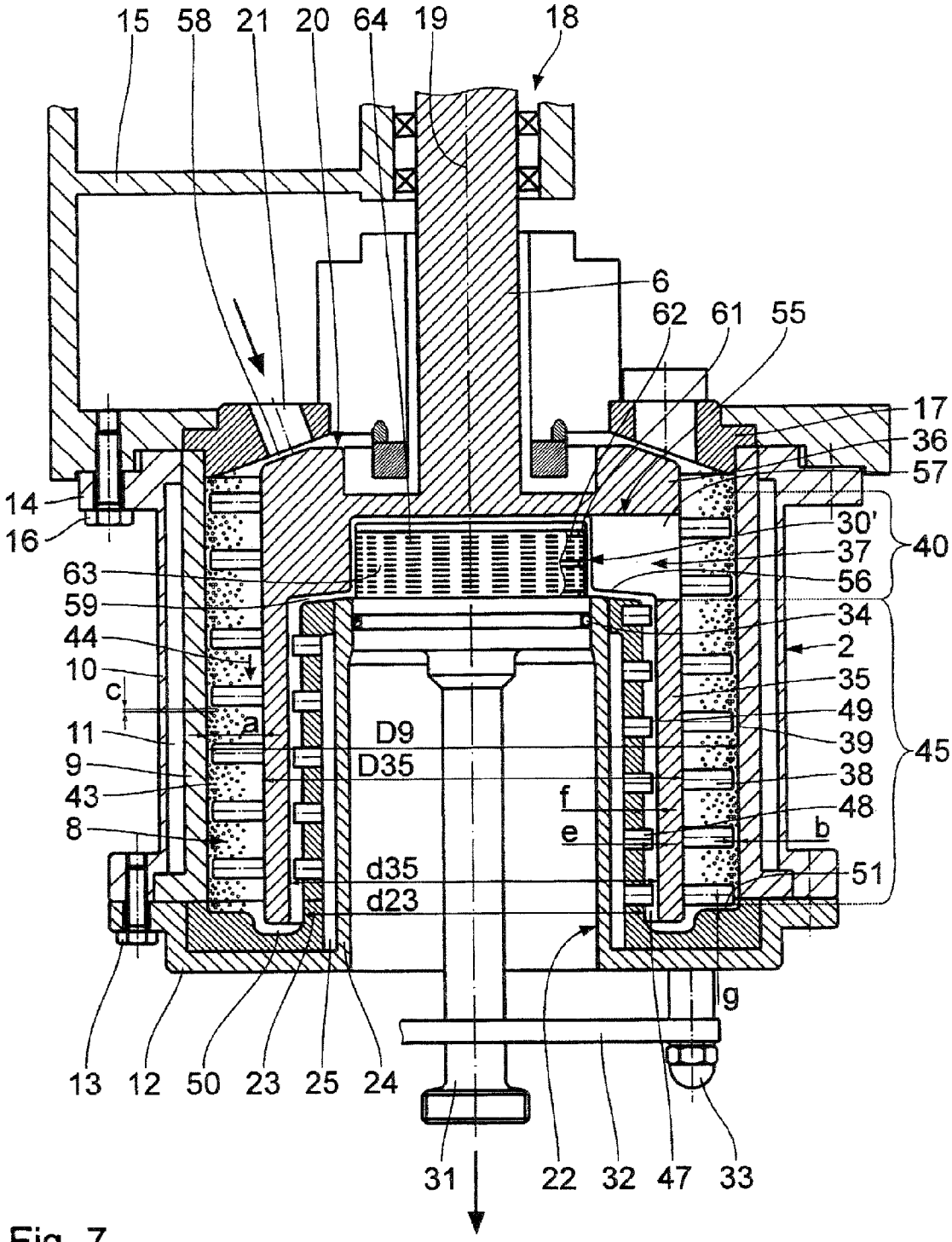
FIG. 7 shows a vertical longitudinal section through a third embodiment of the agitator mill.

The embodiment according to FIG. 7 differs from that according to FIG. 2 only in that the protective screen 30' has a support body 61 connected to the interior stator 22 in a known manner, said support body 61 being provided with slot-like openings 62. A very thin piece of sheet metal or a film 63, respectively, is disposed on the outside of said support body 61, said film 63 being provided with very fine separating slots 64 the true width of which cannot be represented in the drawing but is clearly smaller than the diameter c of the smallest auxiliary grinding bodies 43.

Figure 8:
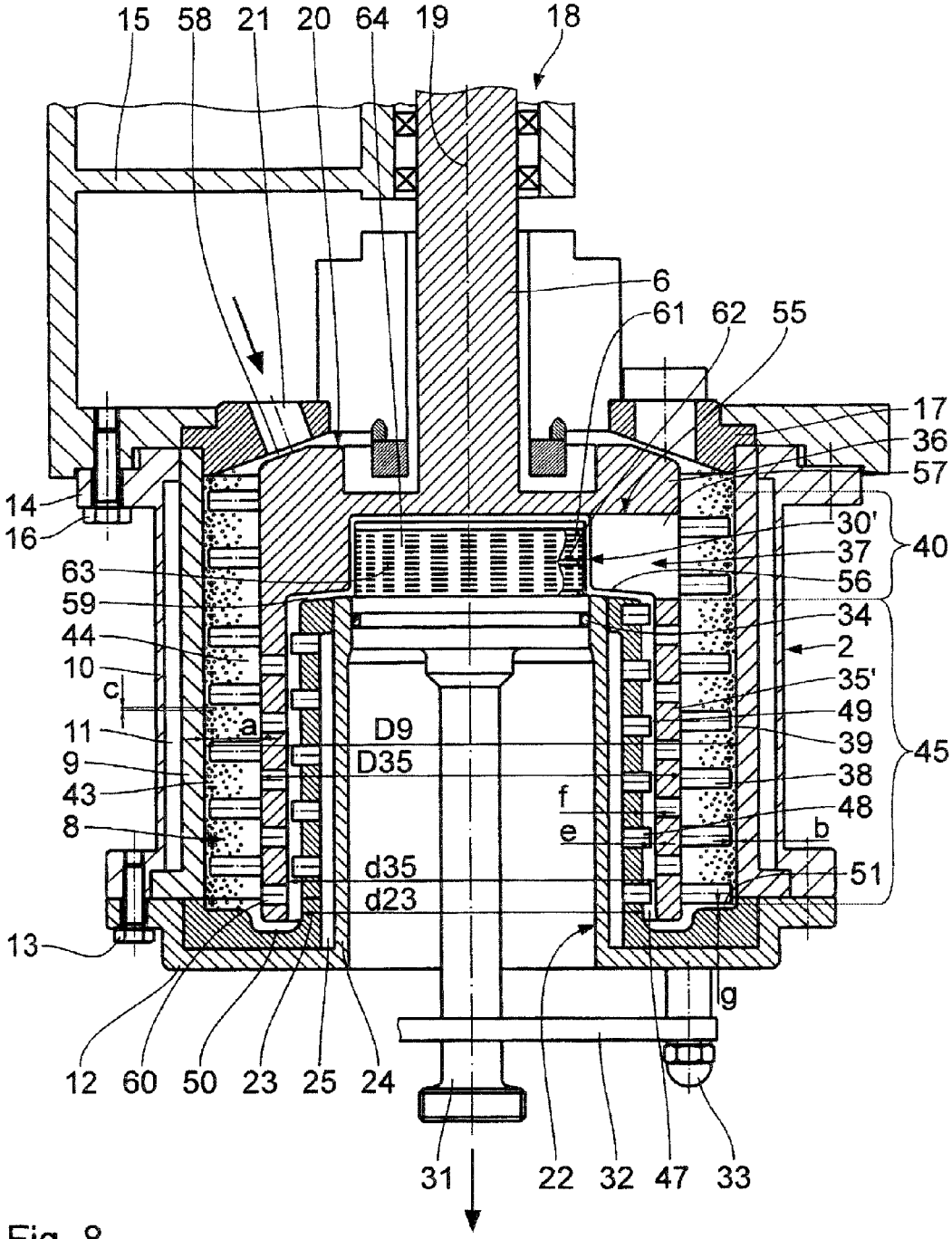
FIG. 8 shows a vertical longitudinal section through a fourth embodiment of the agitator mill.

The agitator mill according to FIG. 8 differs from that according to FIG. 2 in that the rotor 35' is provided with the auxiliary-grinding-body return conduits 60 according to the embodiment of FIG. 5 and the protective screen 30' according to the embodiment of FIG. 7.

Figure 9:
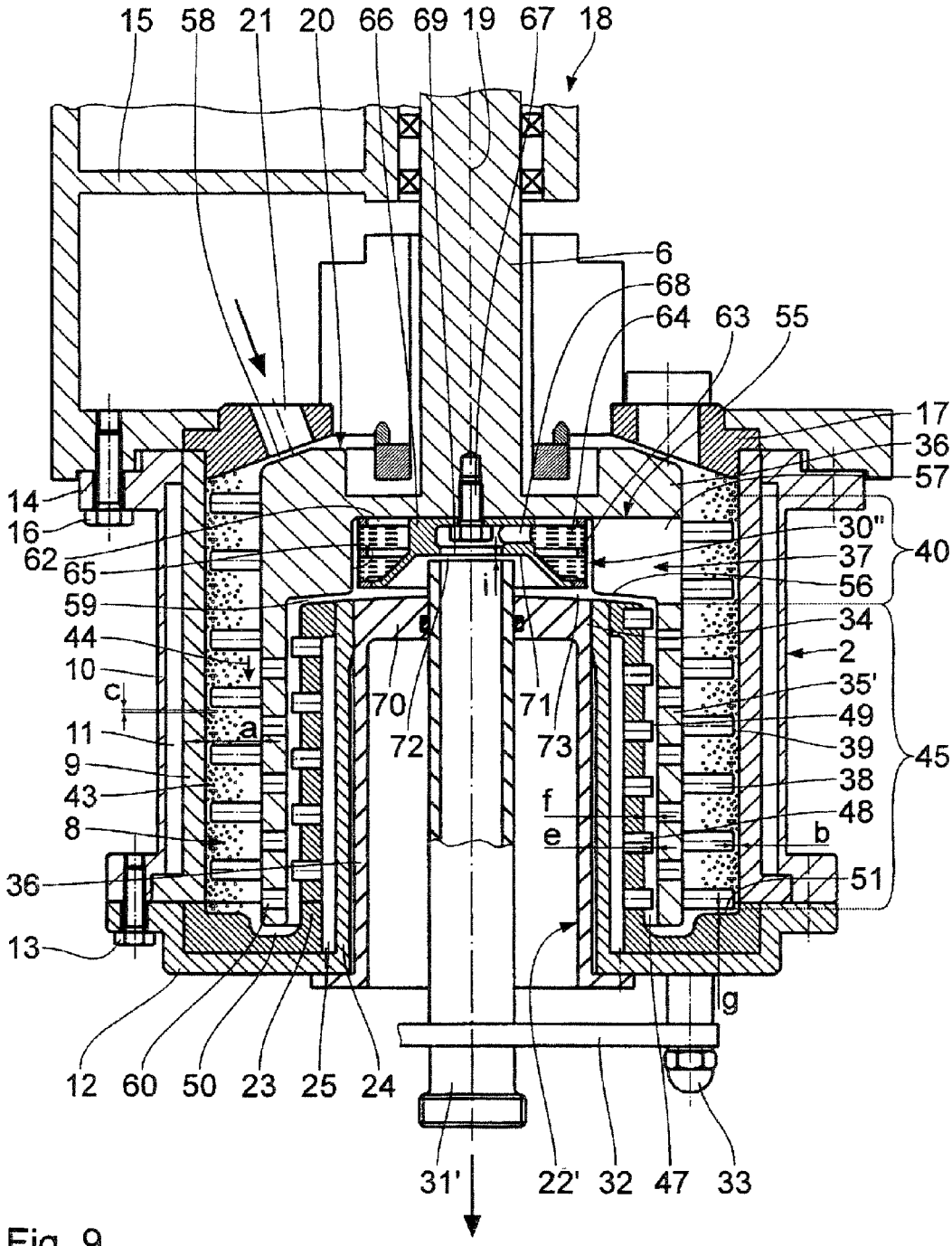
FIG. 9 shows a longitudinal section through a fifth embodiment of the agitator mill.

The embodiment according to FIG. 9 basically corresponds to that according to FIGS. 5 and 7, with the rotor 35' being provided with the auxiliary-grinding-body return conduits 60. The protective screen 30", however, is not fixed to the interior stator 22 but is disposed in the closing member 36 of the rotor 35' in which a cylindrical recess 65 is formed that encloses or comprises, respectively, all of the protective screens 30, 30', 30". The protective screen 30" has a support body 66 which is secured to the closing member 36 of the rotor 35' by means of a screw 67. The support body 66 is provided with slot-like openings 62, with its cylindrical outer circumference being covered by a foil or a piece of sheet metal 63, respectively, comprising separating slots 64. A discharge 68 is formed in the support body 66, said discharge 68 having a discharge opening 69, which is concentric with the axis 19, on the side facing towards the interior stator 22'. The grinding-stock discharge line 31' extends through the otherwise closed upper front wall 70 of the interior stator 22' in a sealed manner as far as into the vicinity of the facing closing wall 71 of the protective sleeve filter 30". A narrow gap 72 is formed between the grinding-stock discharge line 31' and said closing wall 71. Said gap 72 usually has a width i which is smaller than the smallest diameter c of the auxiliary grinding bodies 43. The width i of the gap 72 must be small enough for a sufficiently high pressure loss to occur when the ground grinding stock is discharged, thereby allowing the grinding stock to be discharged through the protective screen 30".

The closing wall 71 of said protective screen 30" opens towards the front wall 70 in the shape of a truncated cone, thereby defining an annular gap 73 at the radially outer area thereof facing towards the front wall 70, said annular gap 73 allowing virtually no auxiliary grinding bodies 43 to enter when the agitator mill is in use. Auxiliary grinding bodies 43 that may have entered this area during standstill are thrown outward again through the annular gap 73 so as to enter the auxiliary-grinding-body return conduits 55.

In this embodiment, the protective screen 30", together with the foil or piece of sheet metal 63 thereof, respectively, is also perfectly aligned with the auxiliary-grinding-body return conduits 55 in the axial direction. In case any auxiliary grinding bodies 43 do manage to enter the area of the protective screen 30", they are also thrown into the return conduits 55 by the foil or piece of sheet metal 63, respectively, forming the cylindrical circumference thereof.

Although each of the previously described embodiments shows agitator mills having a vertical central longitudinal axis 19, the described embodiments may easily be fitted in a horizontal position or in an intermediate position.

In case of using auxiliary grinding bodies 43 of an extremely small diameter c, i.e. micro-auxiliary grinding bodies, the grinding stock has a very low viscosity in the range of 1 to 100 mPas.

What is claimed is:

1. Agitator mill for treating free-flowing grinding stock, comprising a grinding receptacle (2) which defines a substantially closed grinding chamber (8) by means of a receptacle wall (9) and an agitator (20) which is rotatably drivably disposed in the grinding receptacle (2) in a direction of rotation (42) and which is cup-shaped with respect to a common central longitudinal axis (19), and which has an annular cylindrical rotor (35, 35') which is provided with implements (38) extending as far as into the vicinity of the receptacle wall (9), and an interior stator (22, 22') which is disposed within the rotor (35, 35'), which is joined to the grinding receptacle (2), and which has a closed outer wall (23), wherein the annular cylindrical grinding chamber (8) is formed between the receptacle wall (9) and the rotor (35, 35') and receives auxiliary grinding bodies (43) with a diameter c, and wherein an annular cylindrical interior chamber in the shape of an annular gap is formed between the rotor (35, 35') and the outer wall (23) of the interior stator (22, 22'), said interior chamber being disposed coaxially within the grinding chamber (8) and connected thereto via a deflection conduit (50), and wherein a grinding-stock supply chamber (58), which is disposed upstream of the grinding chamber (8) and opens into the latter in a direction of flow (44), and a protective screen (30, 30"), which is disposed downstream of the interior chamber (8) in the direction of flow (44), are disposed approximately on the same side of the grinding receptacle (2) for the grinding stock to pass through, and wherein auxiliary-grinding-body return conduits (55) are provided in the agitator (20) for returning the auxiliary grinding bodies (43) from the vicinity of the protective screen (30, 30") into the grinding chamber (8), said return conduits (55) connecting the end of the interior chamber to the beginning of the grinding chamber (8), wherein the interior chamber is a grinding-stock discharge conduit (47), and wherein devices are provided to prevent a carry-over of auxiliary grinding bodies (43) from the grinding chamber (8) into the grinding-stock discharge conduit (47).

2. Agitator mill according to claim 1, wherein the following applies to the relationship between the internal diameter D35 of the grinding chamber (8) and the external diameter D9 of the grinding chamber (8): $0.6 \leqq D35/D9 \leqq 0.95$.

3. Agitator mill according to claim 2, wherein said relationship between the internal diameter D35 of the grinding chamber (8) and the external diameter D9 of the grinding chamber (8) is $0.7 \leqq D35/D9 \leqq 0.85$.

4. Agitator mill according to claim 1, wherein the following applies to the relationship between the internal diameter d23 of the discharge conduit (47) and the external diameter d35 of the discharge conduit (47): $0.8 \leqq d23/d35 \leqq 0.98$.

5. Agitator mill according to claim 4 wherein said relationship between the internal diameter d23 of the discharge conduit (47) and the external diameter d35 of the discharge conduit (47) is $0.9 \leqq d23/d35 \leqq 0.98$.

6. Agitator mill according to claim 1, wherein the implements (38) fixed to the rotor (35, 35') leave only a narrow gap (39) in relation to the receptacle wall (9), wherein the gap (39) between the implements (38) and the receptacle wall (9) has a gap width b to which applies in relation to the diameter c of the auxiliary grinding bodies (43): $4c \leqq b \leqq 6c$, the minimum gap width b being defined as: $1.0mm \leqq b \leqq 2.0mm$.

7. Agitator mill according to claim 1, wherein, seen in the circumferential direction of the rotor (35, 35'), the implements (38) are disposed along a helical curve (46) in a second area (45) between the auxiliary-grinding-body return conduits (55) and the deflection conduit (5) so as to overlap with one another, thereby imparting a momentum to the auxiliary grinding bodies (43) that is opposite to the direction of flow (44) when the rotor (35,35') is rotatably driven in a direction of rotation (42).

8. Agitator mill according to claim 7, wherein wiper elements (48) are disposed along the interior stator (22, 22') and extend towards the rotor (35, 35'), and wherein the rotor (35, 35') is free of implements on the inside thereof defining the grinding-stock discharge conduit (47).

9. Agitator mill according to claim 8, wherein, the wiper elements (48) leave a gap (49) in relation to the rotor (35, 35') to the gap width e thereof applies the following in relation to the diameter c of the auxiliary grinding bodies (43): $4c \leqq e \leqq 6c$, with a minimum gap width e being defined as: $1.0mm \leqq c \leqq 2.0mm$.

10. Agitator mill according to claim 8, wherein wiper elements (48) disposed along the interior stator (22, 22') overlap with one another in the direction of the central longitudinal axis (19) and are disposed along a helical curve in the circumferential direction of the interior stator (22, 22') in a way as to impart a momentum to the auxiliary grinding bodies (43) in the direction of flow (44) when the rotor (35, 35') is driven in the direction of rotation (42).

11. Agitator mill according to claim 1, wherein, the grinding chamber (8) has a bottom surface (51) upstream of the deflection conduit (50), said bottom surface (51) being wiped by the nearest implement (38) while leaving a distance g uncovered.

12. Agitator mill according to claim 11, wherein, the following applies to the distance g between the bottom surface (51) and the nearest implement (38) in relation to the diameter c of the auxiliary grinding bodies (43):$4c \leqq g \leqq 6c$, with the minimum distance g being defined as: $1.0mm \leqq g \leqq 2.0mm$.

13. Agitator mill according to claim 11, wherein, the deflection conduit (50) projects out of the grinding chamber (8) directly next to the rotor (35, 35') and wherein the bottom surface (51) is disposed radially beyond thereof.

14. Agitator mill according to claim 1, wherein, the interior stator (22,22') is provided with a cooling chamber (25).

15. Agitator mill according to claim 1, further comprising small auxiliary-grinding-body return conduits (60) connecting the grinding-stock discharge conduit (47) to the grinding chamber (8) and formed in the rotor (35'), wherein to the diameter h thereof applies: $5.0mm \leqq h \leqq 30.0mm$.

16. Agitator mill according to claim 1, wherein the auxiliary-grinding-body return conduits (60) are disposed to overlap with one another in the direction of the central longitudinal axis (19) and along a helical curve rising from the deflection conduit (15) towards the protective screen (30, 30', 30") in the direction of rotation (42).

17. Agitator mill according to claim 1, wherein the following applies to the diameter c of the auxiliary grinding bodies (43): $c \leqq .3$ mm.

18. Agitator mill according to claim 17, wherein the following applies to the diameter c of the auxillary grinding bodies (43): $0.02mm \leqq c \leqq .1$ mm.

* * * * *